US007610726B2

(12) United States Patent
Lajewski

(10) Patent No.: US 7,610,726 B2
(45) Date of Patent: Nov. 3, 2009

(54) HOUSING ASSEMBLY

(75) Inventor: Todd M. Lajewski, Lapeer, MI (US)

(73) Assignee: Tapco International Corporation, Wixom, MI (US)

( * ) Notice: Subject to any disclaimer, the term of this patent is extended or adjusted under 35 U.S.C. 154(b) by 323 days.

(21) Appl. No.: 11/429,045

(22) Filed: May 5, 2006

(65) Prior Publication Data

US 2006/0272231 A1 Dec. 7, 2006

Related U.S. Application Data

(60) Provisional application No. 60/678,026, filed on May 5, 2005.

(51) Int. Cl.
*E04D 13/00* (2006.01)
*E04B 1/70* (2006.01)
*F24F 13/08* (2006.01)

(52) U.S. Cl. ..... 52/97; 52/302.1; 52/302.3; 52/199; 248/220.21; 454/358; 454/368

(58) Field of Classification Search ..... 52/198, 52/218, 97, 302.1, 220.8, 208, 219, 209, 52/204.54, 473, 199, 60, 302.3; 454/358, 454/368; 248/225.21, 56, 220.21; 174/50, 174/480, 481
See application file for complete search history.

(56) References Cited

U.S. PATENT DOCUMENTS

| | | | | |
|---|---|---|---|---|
| 280,085 | A * | 6/1883 | Sage | 285/43 |
| 2,764,929 | A * | 10/1956 | Tegarty | 454/271 |
| 3,011,422 | A | 12/1961 | Scallon | |
| 3,105,664 | A * | 10/1963 | Poradun | 248/56 |
| 3,209,669 | A * | 10/1965 | Bayne | 454/368 |
| 3,318,476 | A * | 5/1967 | Clark | 220/3.4 |
| 3,680,471 | A * | 8/1972 | Rosendale | 454/259 |
| 3,939,616 | A | 2/1976 | Schapker | |
| 4,452,024 | A | 6/1984 | Sterriker et al. | |
| 4,563,846 | A * | 1/1986 | Webb | 52/208 |
| 4,646,488 | A | 3/1987 | Burns | |
| 4,726,152 | A | 2/1988 | Vagedes et al. | |
| 4,833,847 | A * | 5/1989 | Inayama et al. | 52/208 |

(Continued)

FOREIGN PATENT DOCUMENTS

EP 0366162 * 5/1989

(Continued)

OTHER PUBLICATIONS

US 6,898,904, 05/2005, Bonshor (withdrawn)

*Primary Examiner*—Robert J Canfield
*Assistant Examiner*—Brent W Herring
(74) *Attorney, Agent, or Firm*—Howard & Howard Attorneys PLLC

(57) ABSTRACT

A housing assembly for mounting to a wall of a building is disclosed. The housing assembly includes a front plate attached to a back plate. The back plate defines an axis and has a flange extending radially away from the axis for coupling to the wall. An insert is disposed between the front plate and the back plate. The insert includes a central body having a fluid diverter extending outwardly from the central body for guiding a fluid away from the wall. The housing assembly further includes a locking device for selectively coupling and uncoupling the insert from one of the front plate and the back plate.

28 Claims, 4 Drawing Sheets

U.S. PATENT DOCUMENTS

| | | | | | |
|---|---|---|---|---|---|
| 4,875,318 | A | * | 10/1989 | MacLeod et al. | 52/211 |
| 4,897,974 | A | * | 2/1990 | Lane | 52/199 |
| 4,920,708 | A | | 5/1990 | MacLeod et al. | |
| 5,000,409 | A | | 3/1991 | MacLeod et al. | |
| 5,018,333 | A | | 5/1991 | Bruhm | |
| 5,117,597 | A | | 6/1992 | Feller | |
| 5,144,777 | A | * | 9/1992 | Fishel et al. | 52/144 |
| 5,154,471 | A | * | 10/1992 | Mimura et al. | 296/93 |
| 5,222,336 | A | * | 6/1993 | Yada et al. | 52/208 |
| 5,303,522 | A | * | 4/1994 | Vagedes | 52/97 |
| 5,326,060 | A | * | 7/1994 | Chubb et al. | 248/231.9 |
| 5,349,799 | A | | 9/1994 | Schiedegger et al. | |
| 5,397,093 | A | * | 3/1995 | Chubb et al. | 248/544 |
| 5,402,611 | A | * | 4/1995 | Vagedes | 52/198 |
| 5,549,266 | A | | 8/1996 | Mitchell et al. | |
| 5,561,952 | A | * | 10/1996 | Damron | 52/198 |
| 5,596,852 | A | * | 1/1997 | Schiedegger | 52/212 |
| 5,664,375 | A | * | 9/1997 | Ward | 52/97 |
| 5,675,940 | A | | 10/1997 | Bahar et al. | |
| 5,722,208 | A | * | 3/1998 | Humphrey et al. | 52/220.8 |
| 5,729,935 | A | * | 3/1998 | Schiedegger et al. | 52/198 |
| 5,765,325 | A | * | 6/1998 | DeBlock | 52/204.5 |
| 5,782,051 | A | * | 7/1998 | LaVoie | 52/473 |
| 5,822,933 | A | | 10/1998 | Burroughs et al. | |
| 5,918,431 | A | * | 7/1999 | Schiedegger et al. | 52/220.1 |
| 5,921,038 | A | | 7/1999 | Burroughs et al. | |
| 6,052,959 | A | | 4/2000 | LaBrosse | |
| 6,076,310 | A | | 6/2000 | Kim | |
| 6,113,488 | A | * | 9/2000 | Tiede | 454/276 |
| 6,119,416 | A | | 9/2000 | Larson | |
| 6,151,838 | A | | 11/2000 | Husein | |
| 6,155,008 | A | | 12/2000 | McKee | |
| 6,196,915 | B1 | * | 3/2001 | Schiedegger et al. | 454/339 |
| 6,276,099 | B1 | * | 8/2001 | O'Shea | 52/204.1 |
| 6,354,046 | B1 | | 3/2002 | Swearingen | |
| 6,383,072 | B2 | * | 5/2002 | Schiedegger et al. | 454/339 |
| 6,386,972 | B1 | * | 5/2002 | Schiedegger et al. | 454/358 |
| 6,481,164 | B1 | * | 11/2002 | McCorkel | 52/58 |
| 6,543,186 | B2 | | 4/2003 | Gilleran | |
| 6,604,333 | B1 | * | 8/2003 | Schiedegger et al. | 52/456 |
| 6,619,004 | B2 | | 9/2003 | Loper | |
| 6,951,081 | B2 | * | 10/2005 | Bonshor | 52/97 |
| RE38,881 | E | * | 11/2005 | Chubb et al. | 248/231.9 |
| 7,024,824 | B1 | * | 4/2006 | Widlacki et al. | 52/58 |
| 7,024,830 | B2 | * | 4/2006 | Schiedegger et al. | 52/204.61 |
| 7,044,318 | B2 | * | 5/2006 | Gates, II | 220/3.94 |
| 7,516,578 | B2 | * | 4/2009 | Bonshor | 52/97 |
| 2003/0136060 | A1 | * | 7/2003 | Bonshor | 52/97 |
| 2003/0177725 | A1 | * | 9/2003 | Gatherum | 52/302.1 |
| 2003/0213190 | A1 | * | 11/2003 | Schiedegger et al. | 52/204.54 |
| 2004/0226225 | A1 | | 11/2004 | Olk et al. | |
| 2005/0055920 | A1 | * | 3/2005 | Lajewski | 52/302.1 |
| 2006/0213132 | A1 | * | 9/2006 | Bonshor | 52/97 |
| 2007/0044393 | A1 | * | 3/2007 | Bonshor | 52/97 |

FOREIGN PATENT DOCUMENTS

| | | |
|---|---|---|
| EP | 0 366 162 A2 | 5/1990 |
| EP | 0 874 101 A1 | 10/1998 |
| WO | WO 87/02731 | 5/1987 |
| WO | WO 93/08342 | 4/1993 |

* cited by examiner

HOUSING ASSEMBLY

CROSS REFERENCE TO RELATED APPLICATION

This application claims the benefit of U.S. provisional patent application Ser. No. 60/678,026, which was filed on May 5, 2005.

BACKGROUND OF THE INVENTION

1. Field of the Invention

The present invention relates to a housing assembly for mounting to a wall of a building.

2. Description of the Prior Art

Various housing assemblies having fluid diverters for redirecting a fluid away from a wall of a building are known in the art. Such an assembly is disclosed in U.S. Pat. No. 6,951,081 (the '081 patent) to Bonshor. The '081 patent discloses a housing assembly having a front plate and a back plate attached to one another and disposed on a wall of a building. The back plate defines an axis and includes a flange extending radially away from the axis for coupling to the wall. The flange includes a fluid diverter for guiding a fluid away from the wall of the building. However, the fluid diverter is permanently attached to the back plate which makes it difficult to clean and expensive to replace.

In addition, United States Publication No. 2005/0055920 to Lajewski discloses a housing assembly having an insert that is removable. The housing assembly includes a front plate and a back plate in which the insert is disposed the front and back plates. The insert attaches to the back plate to prevent animals from entering an exhaust vent. However, the insert lacks a fluid diverter to divert a fluid away from a wall of a building.

Therefore, there remains a need to develop a housing assembly having a locking device for selectively coupling and uncoupling an insert with a fluid diverter.

SUMMARY OF THE INVENTION AND ADVANTAGES

The present invention provides for a housing assembly to mount to a wall of a building. The housing assembly includes a front plate attached to a back plate. The back plate defines an axis and includes a flange extending radially away from the axis for coupling to the wall. An insert is disposed between the front plate and the back plate. The insert includes a central body having a fluid diverter extending outwardly from the central body for redirecting a fluid away from the wall of the building. The housing assembly includes a locking device for selectively coupling and uncoupling the insert from one of the front plate and the back plate.

The present invention therefore provides for a housing assembly having a locking device that allows an insert with a fluid diverter to be removed for cleaning and accessibility to other parts of the housing assembly, such as a back plate. Additionally, the fluid diverter redirects a fluid away from a wall of a building for preventing damage to the wall. Furthermore, the insert is cheaper and easier to replace than conventional fluid diverters because the insert is a separate piece from the back plate.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
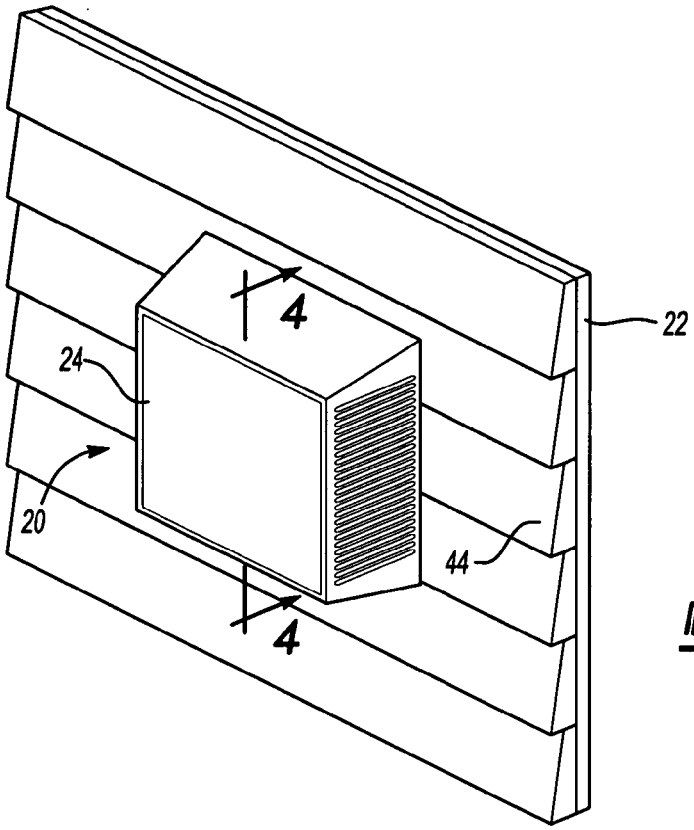
FIG. 1 is a perspective view of a housing assembly attached to a wall.

Referring to the Figures, wherein like numerals indicate corresponding parts throughout the several views, a housing assembly 20 for mounting to a wall 22 of a building (not shown) is generally shown in FIG. 1. Typically, the housing assembly 20 is used to ventilate the building. However, it is to be appreciated that the housing assembly 20 may be used for an electrical outlet, a light fixture, a plumbing fixture, a decorative assembly, a dryer vent, or any other similar use.

Figure 2:
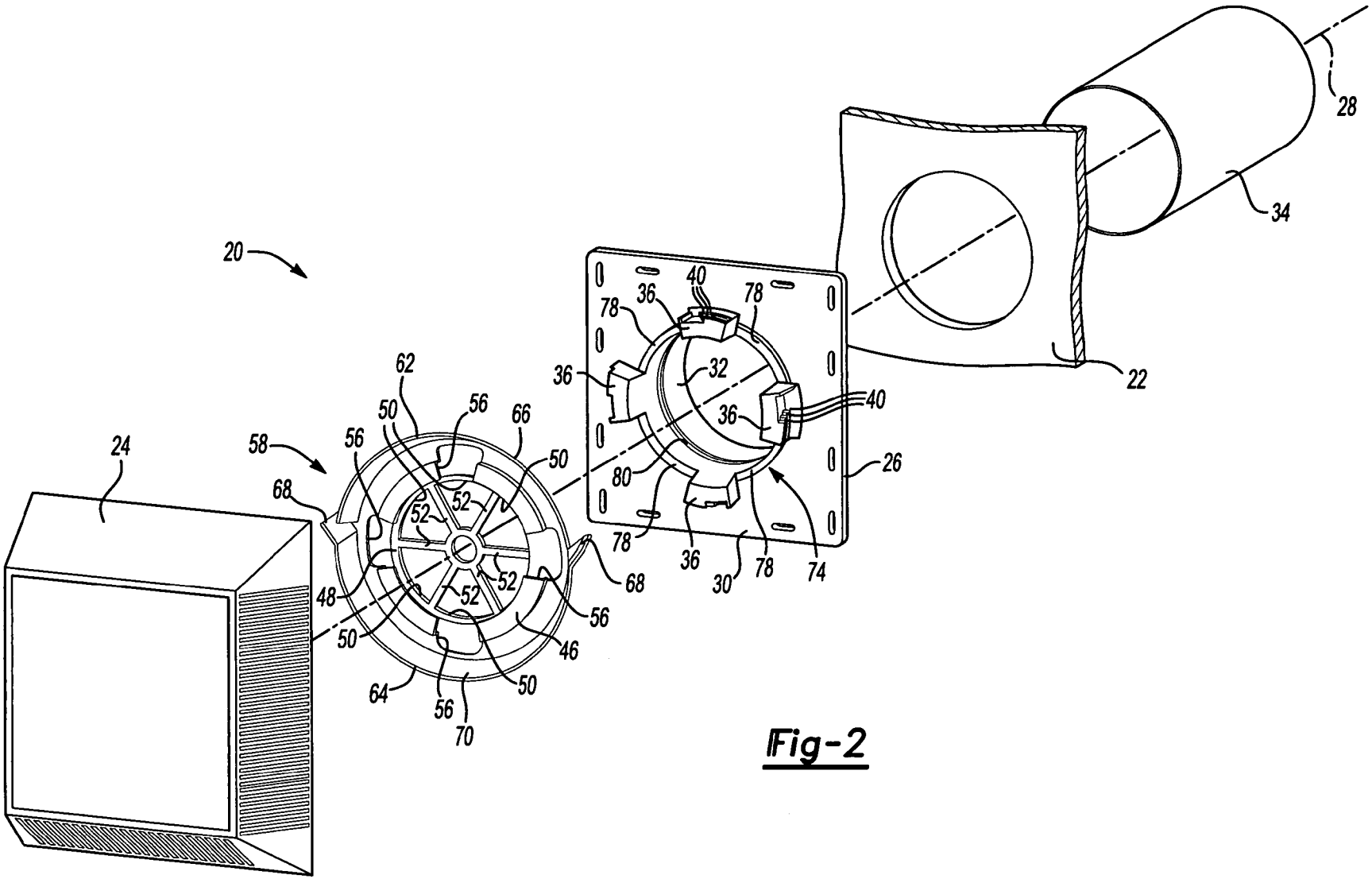
FIG. 2 is a exploded view of the housing assembly in spaced relationship to a wall and an exhaust vent.

Referring to FIG. 2, the housing assembly 20 includes a front plate 24 and a back plate 26. The front plate 24 is attached to the back plate 26 for aesthetic purposes. The back plate 26 defines an axis 28 and includes a flange 30 extending radially away from the axis 28 for coupling the housing assembly 20 to the wall 22. The back plate 26 further defines a void 32 disposed along the axis 28 in which the flange 30 extends radially away from the void 32. An exhaust vent 34 is disposed in the void 32 for ventilating the building. The back plate 26 may be secured to the wall 22 using fasteners, adhesive, or any other method known to those skilled in the art.

Figure 3:
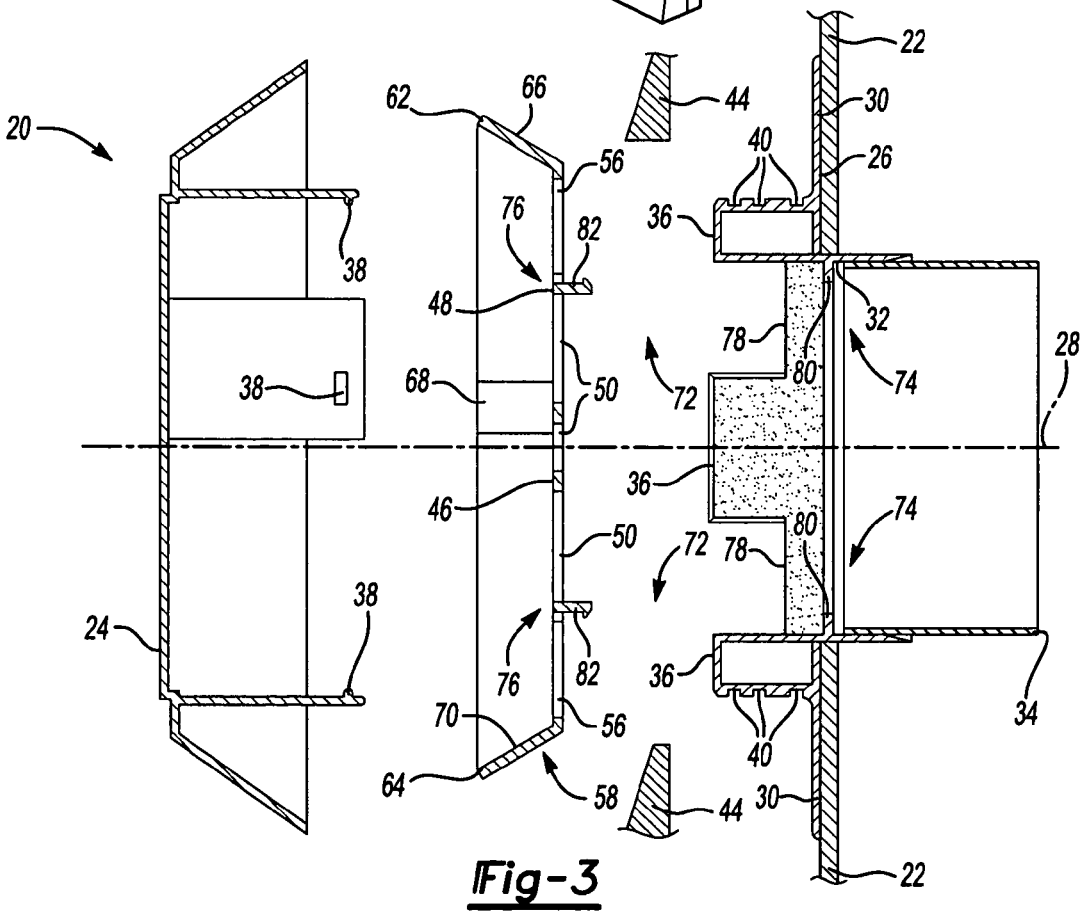
FIG. 3 is a cross-sectional exploded view of the housing assembly mounted to the wall.
Figure 4:
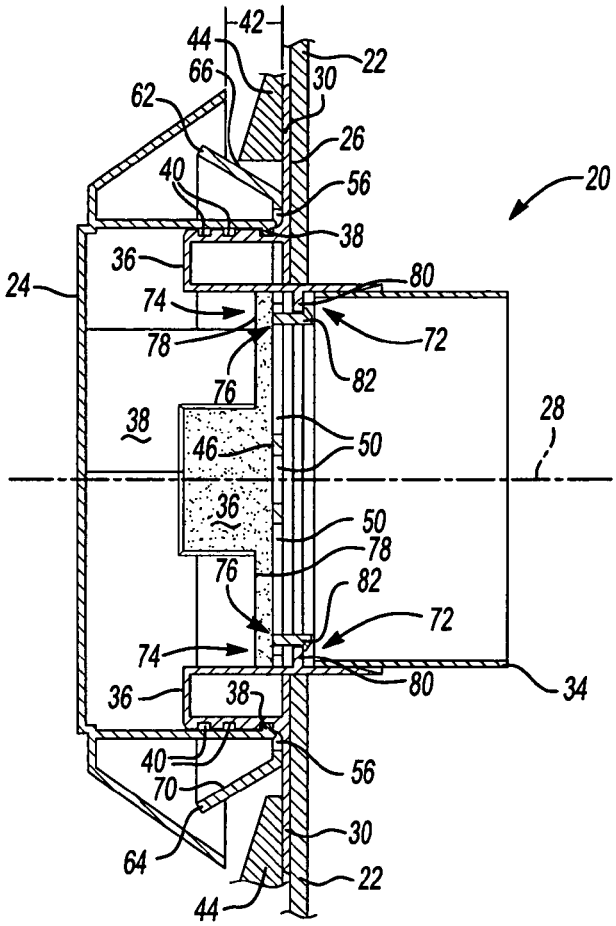
FIG. 4 is a cross-sectional view of the housing assembly taken along line 4-4 in FIG. 1.
Figure 5:
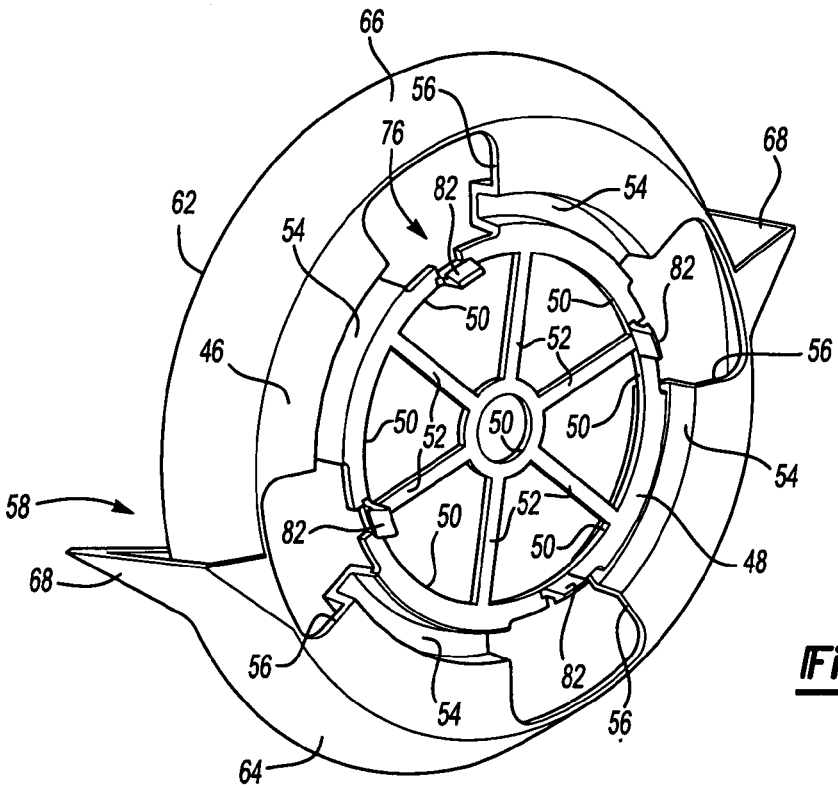
FIG. 5 is a perspective back view of an insert having a fluid diverter.
Figure 6:
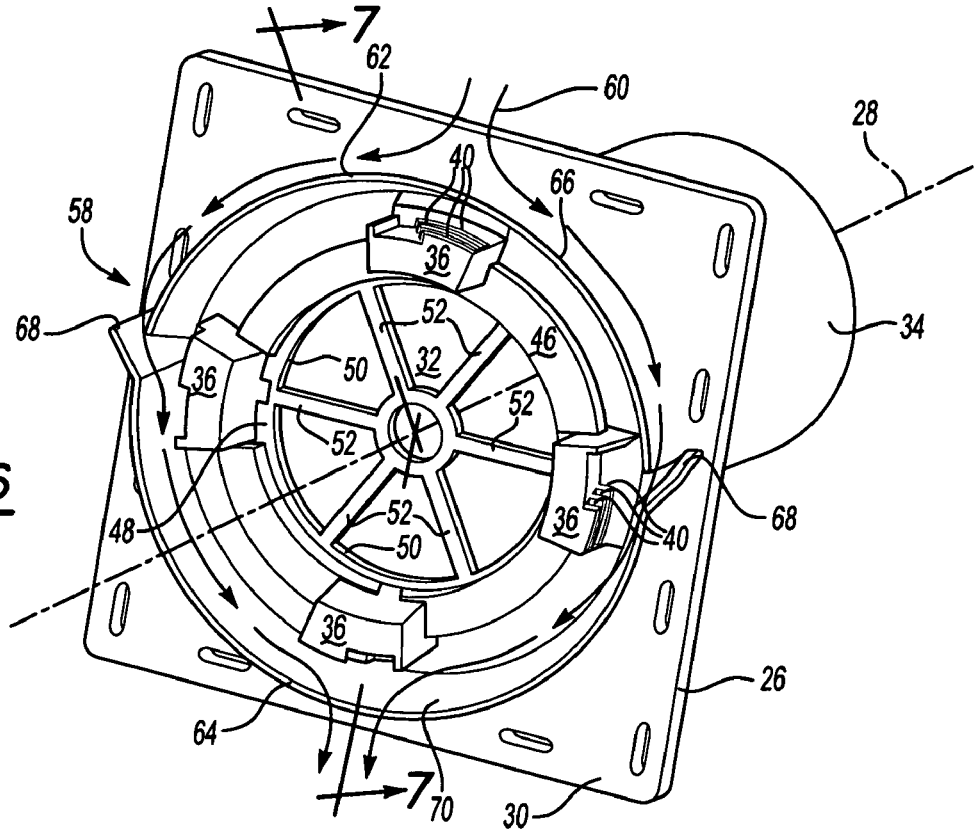
FIG. 6 is a perspective view of the housing assembly having a front plate removed.
Figure 7:
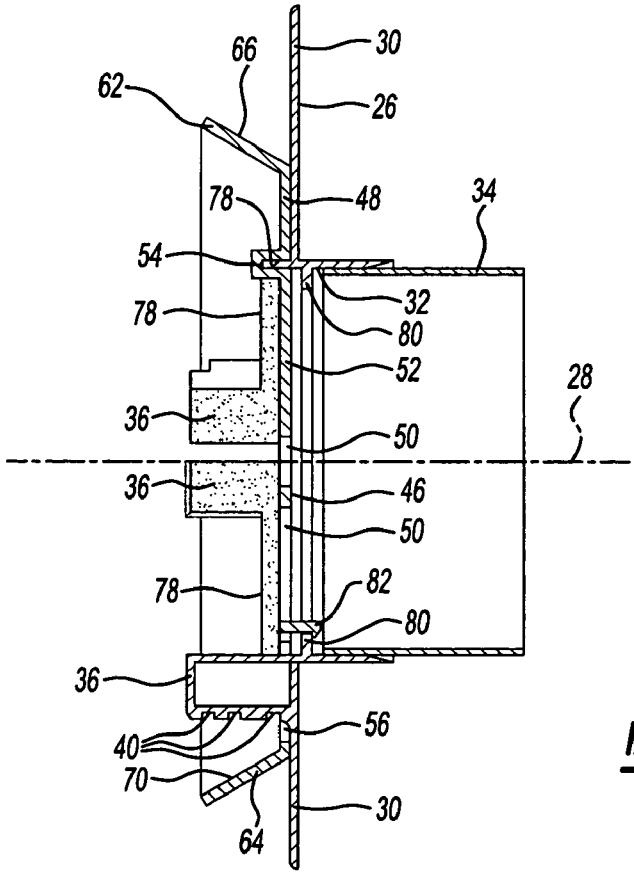
FIG. 7 is a cross-sectional view of the housing assembly having the front plate removed taken along line 7-7 in FIG. 6.

Referring also to FIGS. 3, 4, and 7, a plurality of adjustment devices 36 are disposed on one of the front plate 24 and the back plate 26. The adjustment devices 36 are spaced from one another for securing the front plate 24 to the back plate 26. A raised portion 78 extends from one of the front plate 24 and the back plate 26 along the axis 28 for supporting the adjustment devices 36. Preferably, the raised portion 78 extends from the back plate 26.

One of the front plate 24 and the back plate 26 includes a plurality of locking fingers 38 spaced from each other for mating with the adjustment devices 36. Preferably, the adjustment devices 36 are disposed on the back plate 26 and the locking fingers 38 are disposed on the front plate 24. Each of the adjustment devices 36 define a plurality of channels 40 for receiving the locking fingers 38 and for adjusting a space 42 between the front and back plates 24, 26. The front plate 24 is secured to the back plate 26 by rotating the front plate 24 which moves the locking fingers 38 into the channels 40 of the adjustment devices 36. Outdoor material 44, such as siding and insulation, is disposed over the flange 30 of the back plate 26. There must be room between the front plate 24 and the back plate 26 to accommodate the outdoor material 44. Therefore, the space 42 is adjustable for accommodating various thicknesses of the outdoor material 44.

As best shown in FIGS. 3-7, an insert 46 is disposed between the front plate 24 and the back plate 26. The insert 46 includes a central body 48 defining at least one aperture 50 along the axis 28. Preferably, the central body 48 includes a plurality of spokes 52 disposed in the aperture 50 to prevent animals from entering the exhaust vent 34. It is to be appreciated that a screen (not shown) may be disposed between the spokes 52 to prevent small items from entering the exhaust vent 34, such as leaves and bugs. The central body 48 defines a recess 54 adjacent the spokes 52 for receiving the raised portion 78 to allow the insert 46 to abut the back plate 26. The central body 48 further defines a plurality of holes 56 adjacent the recess 54. The holes 56 are spaced from one another for passing the adjustment devices 36 through the holes 56 to allow the insert 46 to abut the back plate 26.

The central body 48 includes a fluid diverter, generally shown at 58, extending outwardly from the central body 48 for redirecting a fluid 60 away from the wall 22 of the building to prevent damage to the wall. The fluid diverter 58 includes an upper portion 62 spaced from a lower portion 64 with each of the upper and lower portions 62, 64 extending from the central body 48. The upper portion 62 defines an outer surface 66 angled toward the central body 48 for guiding the fluid 60 toward the lower portion 64. The lower portion 64 includes a pair of wings 68 extending angularly away from the axis 28 for receiving the fluid 60 from the outer surface 66 of the upper portion 62. The lower portion 64 defines an inner surface 70 angled away from the central body 48 for receiving the fluid 60 from the outer surface 66 of the upper portion 62 and for guiding the fluid 60 away from the wall 22 of the building. The fluid diverter 58 abuts one of the front plate 24 and the back plate 26. Preferably, the fluid diverter 58 abuts the back plate 26.

As best shown in FIGS. 3 and 4, the housing assembly 20 further includes a locking device, generally shown at 72, for selectively coupling and uncoupling the insert 46 from one of the front plate 24 and the back plate 26. The locking device 72 allows the insert 46 to be removed for cleaning and accessibility to other parts of the housing assembly 20, such as the back plate 26. The locking device 72 includes a first coupling member, generally shown at 74, and a second coupling member, generally shown at 76, interposed between the front plate 24 and the back plate 26. The first coupling member 74 is further defined a continuous rib 80 extending radially toward the axis 28 from one of the front plate 24 and the back plate 26 for engaging the second coupling member 76. Preferably, the rib 80 extends from the back plate 26 within the void 32.

The second coupling member 76 is further defined as a plurality of tangs 82 spaced from each other and extending from the central body 48 along the axis 28 for engaging the rib 80. The tangs 82 may be disposed adjacent the recess 54 of the central body 48. It is contemplated that the tangs 82 may be disposed anywhere on the central body 48 as long as the tangs 82 engage the rib 80. The tangs 82 may be snapped over the rib 80 to secure the insert 46 to the back plate 26. Preferably, the tangs 82 are press fit to the rib 80. However, it is to be appreciated that the tangs 82 may be attached to the rib 80 in any acceptable method known in the art. The insert 46 may be removed by prying the tangs 82 away from the rib 80 using a knife (not shown) or a screw driver (not shown). It is contemplated that the insert 46 may be removed using any acceptable method known to those skilled in the art, such as pulling the insert 46 away from the back plate 26.

Obviously, many modifications and variations of the present invention are possible in light of the above teachings. The foregoing invention has been described in accordance with the relevant legal standards; thus, the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A housing assembly for mounting to a wall of a building, said assembly comprising;

a back plate defining an axis and having a flange extending radially away from said axis for coupling to the wall with said back plate defining a void along said axis, a front plate attached to said back plate for aesthetic purposes, an insert disposed between said front plate and said back plate and having a central body with a fluid diverter extending outwardly from said central body above and below said void for redirecting a fluid around said void and away from the wall, said fluid diverter including an upper portion spaced from a lower portion with each of said portions extending from said central body, and a locking device for selectively coupling and uncoupling said insert from one of said front plate and said back plate.

2. An assembly as set forth in claim 1 wherein said locking device includes a first coupling member and a second coupling member interposed between said front plate and said back plate.

3. An assembly as set forth in claim 2 wherein said first coupling member is further defined as a continuous rib extending radially toward said axis from one of said front plate and said back plate for engaging said second coupling member.

4. An assembly as set forth in claim 1 further including a raised portion extending from one of said front plate and said back plate along said axis.

5. An assembly as set forth in claim 4 wherein said raised portion extends from said back plate and said central body defines a recess for receiving said raised portion.

6. An assembly as set forth in claim 1 wherein said upper portion defines an outer surface angled toward said central body for guiding the fluid toward said lower portion.

7. An assembly as set forth in claim 6 wherein said lower portion defines an inner surface angled away from said central body for receiving the fluid from said outer surface and for guiding the fluid away from the wall.

8. An assembly as set forth in claim 1 wherein said lower portion includes a pair of wings extending angularly away from said axis to a distal end for receiving the fluid from said upper portion.

9. An assembly as set forth in claim 1 wherein one of said front plate and said back plate includes a plurality of adjustment devices spaced from one another for securing said front plate to said back plate.

10. An assembly as set forth in claim 1 wherein said upper portion is disposed above said void for redirecting the fluid around said void and into said lower portion with said lower portion disposed below said void for guiding the fluid away from the wall.

11. An assembly as set forth in claim 1 wherein said void defines an annular configuration and said upper and lower portions each define a semi-circular configuration extending radially about said void.

12. A housing assembly for mounting to a vertical wall of a building, said assembly comprising;

a back plate defining an axis and having a flange extending radially away from said axis for coupling to the wall with said back plate defining a void along said axis, a front plate attached to said back plate for aesthetic purposes, an insert disposed between said front plate and said back plate and having a central body with a fluid diverter extending outwardly from said central body above and below said void for redirecting a fluid flowing transverse to said axis around said void and away from the wall, and a locking device including a first coupling member selectively engaging a second coupling member with one of said first and second coupling members affixedly connected to said insert for selectively coupling and uncoupling said insert from one of said front plate and said back plate.

13. An assembly as set forth in claim 12 wherein said first coupling member is mounted to said back plate and said second coupling member is affixedly connected to said insert.

14. An assembly as set forth in claim 13 wherein said first coupling member is further defined as a continuous rib extending radially toward said axis from said back plate for engaging said second coupling member.

15. An assembly as set forth in claim 14 wherein said second coupling member is further defined as a plurality of tangs spaced from each other and extending from said central body along said axis for engaging said rib.

16. An assembly as set forth in claim 12 wherein said fluid diverter includes an upper portion spaced from a lower portion with each of said portions extending from said central body.

17. An assembly as set forth in claim 16 wherein said upper portion defines an outer surface angled toward said central body for guiding the fluid toward said lower portion.

18. An assembly as set forth in claim 16 wherein said lower portion includes a pair of wings extending angularly away from said axis to a distal end for receiving the fluid from said upper portion.

19. A housing assembly for mounting to a wall of a building, said assembly comprising;

a back plate defining an axis and having a flange extending radially away from said axis for coupling to the wall with said back plate defining a void along said axis, a front plate attached to said back plate for aesthetic purposes, at least one adjustment device mounted to one of said front plate and said back plate, an insert disposed between said front plate and said back plate and having a central body with a fluid diverter extending outwardly from said central body above and below said void for redirecting a fluid around said void and away from the wall, and said central body defining at least one hole offset from said void of said back plate for allowing passage of said adjustment device through said central body to abut said fluid diverter against one of said front plate and said back plate.

20. An assembly as set forth in claim 19 wherein said at least one adjustment device is further defined as a plurality of adjustment devices spaced from each other and mounted to said back plate.

21. An assembly as set forth in claim 20 wherein said at least one hole is further defined as a plurality of holes spaced from each other with each of said holes allowing passage of one of said adjustment devices for allowing said fluid diverter to abut against said back plate.

22. An assembly as set forth in claim 20 wherein said front plate includes a plurality of locking fingers spaced from each other for mating with said adjustment devices.

23. An assembly as set forth in claim 22 wherein each of said adjustment devices define a plurality of channels for receiving said locking fingers and for adjusting a space between said front plate and said back plate.

24. An assembly as set forth in claim 19 wherein said fluid diverter includes an upper portion spaced from a lower portion with each of said portions extending from said central body.

25. An assembly as set forth in claim 24 wherein said upper portion defines an outer surface angled toward said central body for guiding the fluid toward said lower portion.

26. An assembly as set forth in claim 25 wherein said lower portion includes a pair of wings extending angularly away from said axis to a distal end for receiving the fluid from said upper portion.

27. An assembly as set forth in claim 26 wherein said lower portion defines an inner surface angled away from said central body for receiving the fluid from said outer surface of said upper portion and for guiding the fluid away from the wall.

28. An assembly as set forth in claim 27 wherein said outer surface of said upper portion is angled such that the fluid flows toward the wall, about said void, and into said wings with said inner surface of said lower portion angled such that the fluid flows away from the wall.

* * * * *